US005694655A

United States Patent [19]

Shepler et al.

[11] Patent Number: 5,694,655

[45] Date of Patent: Dec. 9, 1997

[54] ROCKING COLLAPSIBLE BASSINET

[76] Inventors: David C. Shepler, P.O. Box 302, East Randolph, Vt. 05041; Aidan J. Petrie, 77 Parade St., Providence, R.I. 02909

[21] Appl. No.: 633,109

[22] Filed: Apr. 16, 1996

[51] Int. Cl.[6] ..... A47D 9/00; A47D 9/02

[52] U.S. Cl. ..... 5/105; 5/98.3; 5/101

[58] Field of Search ..... 5/98.3, 101, 102, 5/105, 106

[56] References Cited

U.S. PATENT DOCUMENTS

| | | | |
|---|---|---|---|
| 190,817 | 5/1877 | Butler . | |
| 253,502 | 2/1882 | Boutwell . | |
| 278,162 | 5/1883 | McLeon . | |
| 0,692,501 | 2/1902 | Bentley | 5/101 |
| 0,813,521 | 2/1906 | Reilly | 5/101 |
| 2,133,561 | 10/1938 | Thornton-Norris | 5/98.3 |
| 2,425,195 | 8/1947 | Lenthall | 5/98.3 |
| 3,335,433 | 8/1967 | Stopek | 5/105 |
| 3,439,363 | 4/1969 | Meeks | 5/109 |
| 4,021,867 | 5/1977 | Maxwell, Jr. | 5/106 |
| 4,371,206 | 2/1983 | Johnson, Jr. | 297/183 |

*Primary Examiner*—Rodney M. Lindsey
*Assistant Examiner*—Robert G. Santos
*Attorney, Agent, or Firm*—John E. Reilly

[57] ABSTRACT

A rocking bassinet employs rigid, hoop-shaped frame members which are pivotable about a pair of connectors between a laterally rocking position, a stationary position, and a collapsed, or flattened, storage position. One of the frame members may serve as the handle with free ends pivotal between a ground-engaging position which prevents rocking and a non-ground engaging position which allows lateral rocking of the bassinet. The degree of rocking may be regulated by adjustment of the handle between horizontal and vertical positions. A pliable cloth basket and mattress assembly is detachably engageable around a pair of frame members.

27 Claims, 3 Drawing Sheets

ROCKING COLLAPSIBLE BASSINET

BACKGROUND AND FIELD OF INVENTION

This invention relates generally to infant beds or cradles, and more particularly, to a novel and improved portable, rockable bassinet that is collapsible into a flattened position for easy transport and storage and in which the degree of rocking is readily adjustable.

Over the past decade or so, parents have been presented with an ever-broadening selection of products designed for children and, especially, infants, designed to simplify a working or single parent's hectic life. "Baby products" today are intended to provide convenience whenever possible and often cater to the parent whose lifestyle or budget requires that such convenience be affordable. The schedule and budgets of working, or otherwise busy, parents necessitate baby products that can be easily transported to serve multiple uses, and that can be stored to save time.

A variety of mats and cushions have been developed which can be easily packed away into a car or a diaper bag, which the parent can spread onto a floor and lay an infant, and onto which an infant may be placed while a parent attends a social function or even while a parent works at the office. Such mats and cushions, although they allow the baby to lie in a prone position, can obviously not be rocked or otherwise manipulated to soothe and pacify an infant. Parents often attempt to use a seat or other seat to double as a type of cradle or mini-crib for an infant, especially when the carseat comes equipped with a handle by which the seat can be carried. U.S. Pat. No. 4,371,206 discloses such an infant seat having a shell with a curved underbelly that allows the seat to be rocked. A handle can be pivotally adjusted either to allow or prevent rocking. However, this seat is of a unitary construction that does not permit disassembly for transport or storage purposes.

Parents often use strollers as make-shift cribs when traveling or otherwise in transit. While many strollers can be quickly collapsed and stored into a trunk or backseat, they are generally not recommended for use with very small infants as a portable crib or cradle because the seat portion does not offer adequate support for the infant's back and neck. A traditional pram or "buggy" which does allow an infant to lie prone, is relatively large and heavy, and does not lend itself well to portability or storage, as it generally cannot be collapsed for travel in a car and later re-erected.

Likewise, traditional bassinets and cradles, while of a generally smaller construction than the cribs used for larger babies and small children are typically not designed to be easily collapsed for storage or transport. U.S. Pat. Nos. 3,335,433 and 253,502 both show beds which are convertible between a crib and a rockable cradle. Neither of the beds is collapsible, however, nor does either have a mechanism for adjusting the degree of rocking.

Most often, traditional bassinets are unrockable and, while sturdy, can often be expensive, especially when considering that they are generally only used during the infant's first months. Because a parent usually must purchase other countless, perhaps more critical items for an infant, the cost of a larger, more permanent bassinet may be prohibitive to some parents.

Thus, a need exists for a rocking bassinet that is of a lightweight but rugged construction, that is versatile, and in which the degree of rocking can be easily adjusted.

SUMMARY OF THE INVENTION

It is therefore an object of the present invention to provide a rugged, yet lightweight bassinet that may be easily transported and erected with a minimum of effort.

It is a further object of the present invention to provide a portable bassinet that can be collapsed to aid in easy transport or storage when the bassinet is not in use.

Still a further object of the present invention is to provide a collapsible bassinet in which an infant can be rocked and in which the degree and amount of rocking can be easily regulated.

It is another object of the present invention to provide an affordable rocking bassinet that is useful for infants during their first months before they are large enough to safely occupy a crib.

In accordance with the present invention, a bassinet employs open frame members which are pivotal about a pair of connectors between a rocking position and a stationary position. One of the open frame members is pivotal between a ground-engaging position which prevents rocking and a non-ground engaging position and includes adjustment means which regulates the pivotal movement of the frame members. A pair of open frame members form curved ground-engaging supports which will support the bassinet when it is in the rocking position.

The connector elements are located on opposite sides of the bassinet, preferably proximate to the open ends of the handle element. Within each connector element is a plurality of slots and offset portions through which free ends of the frame members pivot and are locked into varying positions. The user can regulate the degree of rocking by adjustment of a frame member, which also functions as a handle, between horizontally and vertically locked positions.

A pair of mattress-retaining hoops are inserted into a recess within the bottom of a pliable, cloth basket. The basket is engagable around a pair of the frame members by securing snaps located along the upper perimeter of the basket around the frame members. The flat bottom surface of the basket, which supports the mattress, is oriented parallel to and suspended above the support surface. The basket may include a canopy which is pivotal between a collapsed and open state to cover one end of the basket. When the bassinet is to be collapsed, or substantially flattened, for storage or transport, the basket may be easily detached from the frame members by unfastening the snaps on the basket, although detachment of the basket is not necessary to collapse, or flatten, the bassinet.

At the free ends of the handle are feet which provide additional support to the bassinet while it is in its expanded state and resting on the support surface, and which also limit lateral rocking of the bassinet.

The above and other objects of the present invention will become more readily appreciated and understood from a consideration of the following detailed description of the preferred form of the present invention when taken together with the accompanying drawings in which:

DETAILED DESCRIPTION OF PREFERRED EMBODIMENT

Referring in more detail to the drawings, FIGS. 1 through 4 illustrate the preferred form of the rocking bassinet 10.

Figure 1:
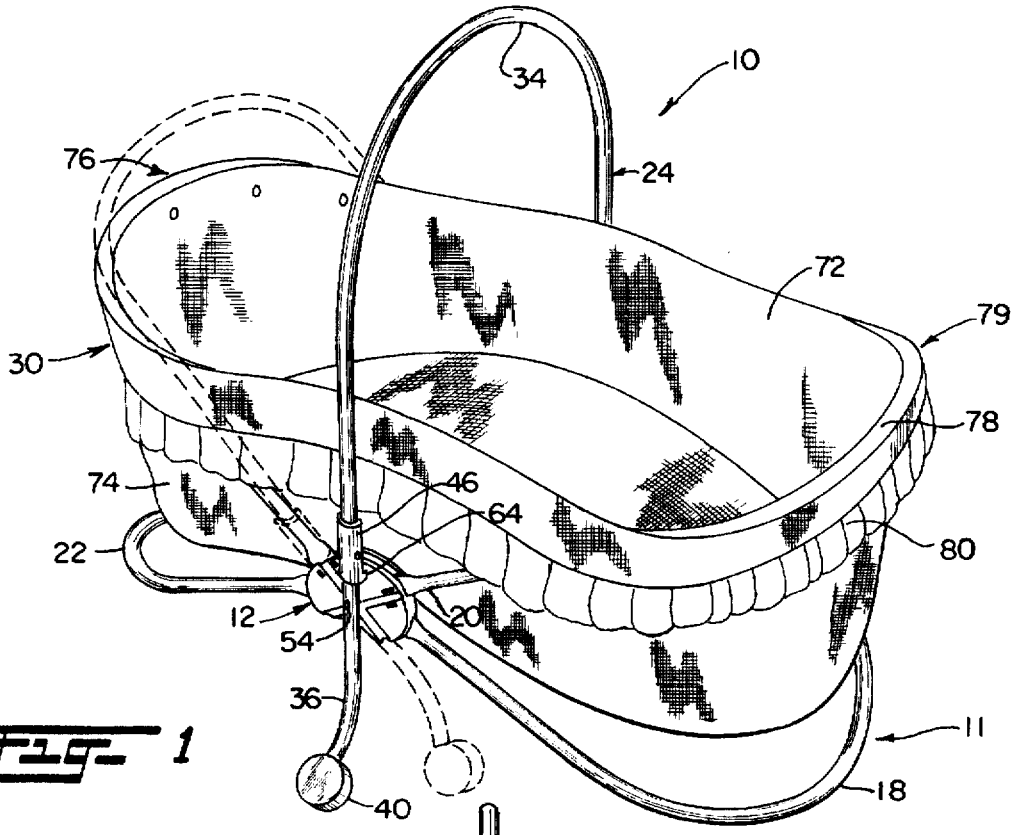
FIG. 1 is a perspective view showing the rocking bassinet of the present invention in an expanded position.
Figure 2:
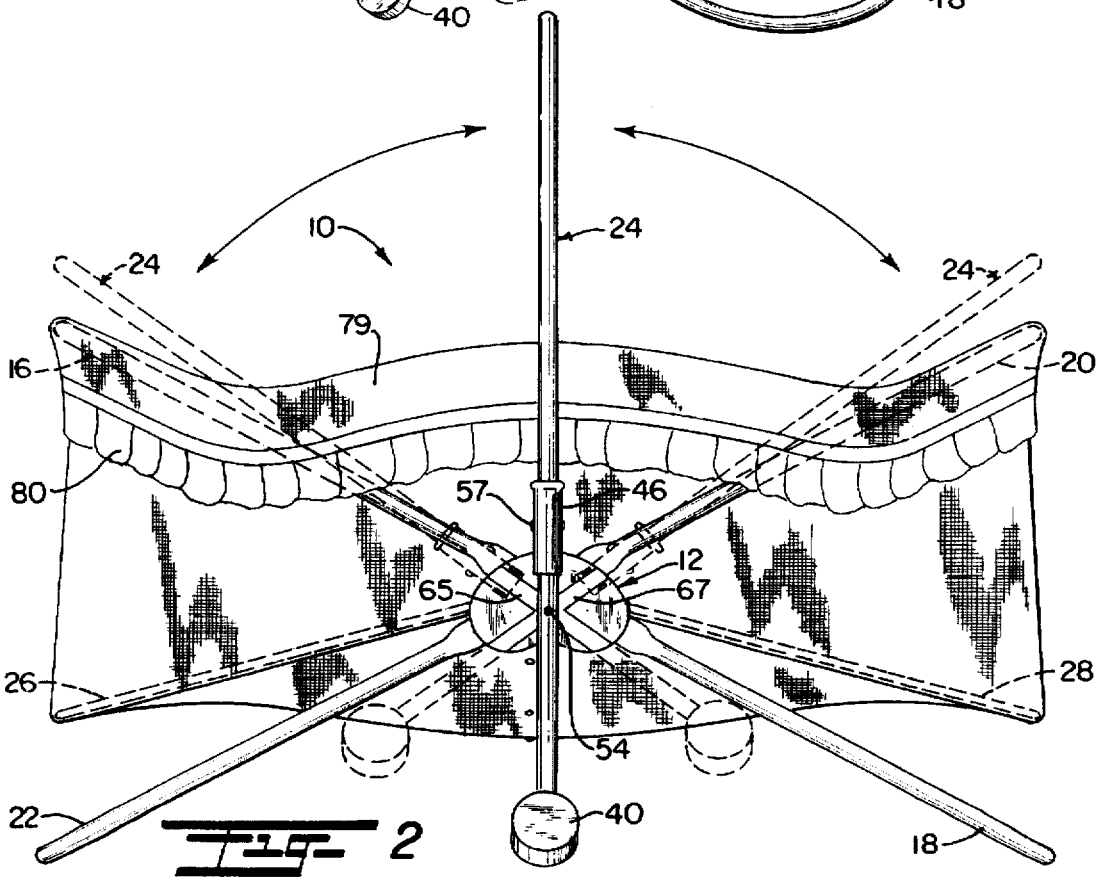
FIG. 2 is a side view of the bassinet of the present invention showing the basket fitted around the mattress retention hoops and frame members.
Figure 4:
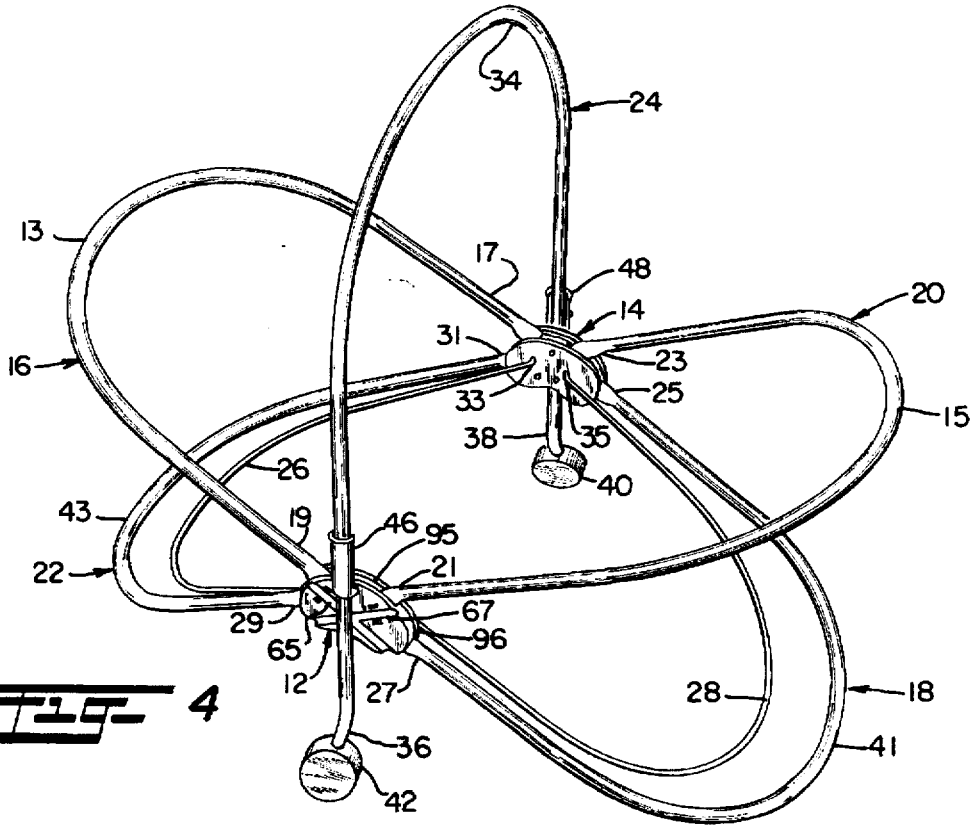
FIG. 4 is a perspective view of the bassinet of the present invention showing the open frame members without the basket and mattress assembly.

In the erected state shown in FIGS. 1, 2 and 4, the bassinet 10 is broadly comprised of a pair of connectors 12, 14 and open frame members 16, 18, 20, 22 and 24 pivotal about the connectors 12, 14 between a rocking position, a stationary, non-rocking position when placed upon a support surface 11 and a collapsed storage position. A pliable, preferably cloth basket 30 is releasably attached to the open frame members 16, 20 so that the underside of the basket 30 hangs above the support surface 11. A pair of mattress retention hoops 26, 28 are inserted into the bottom surface 70 of basket 30, thereby providing rigidity to the basket 30 and support to a mattress that is sized to fit into basket 30. Frame member 24, preferably of a U-shaped configuration, has an upper closed end 34 and ground-engaging lower free ends 36, 38 equipped with feet 40, 42 for added stability of the bassinet 10. When in an upright, vertical position relative to the support surface 11, the frame member 24 may be used as a handle for carrying or moving the bassinet 10. The bassinet 10 includes adjustment means, or handle locks, 46, 48 on the handle 24, activation of which allows the handle 24 to be adjusted between a vertical position and prevents rocking and a angular position, which permits rocking.

Turning next to a closer review of the frame structure, as best shown in FIG. 4, the open frame members 16, 18, 20, 22 and 24, as noted above, are each in the form of a rigid tube or hoop of a generally U-shaped configuration having closed ends and a pair of free ends. More specifically, the frame member 16 has free ends 17, 19 which pivotally engage the connectors 14, 12, respectively. Likewise, the frame member 20 has free ends 21, 23 which also pivotally engage the connectors 12, 14, respectively.

When the bassinet is in its erected state, opposite, upper ends of the basket may be fitted around the frame members 16, 20 in a manner to be described so that the basket is suspended above the support surface.

The closed ends 41, 43 serve as stable ground supports when the bassinet is in the non-rocking position. When the bassinet is in the rocking position to be described, the curved closed ends 41, 43 allow lateral rocking movement about the closed ends 41, 43 when the bassinet is set into motion by a laterally applied force.

Figure 6:
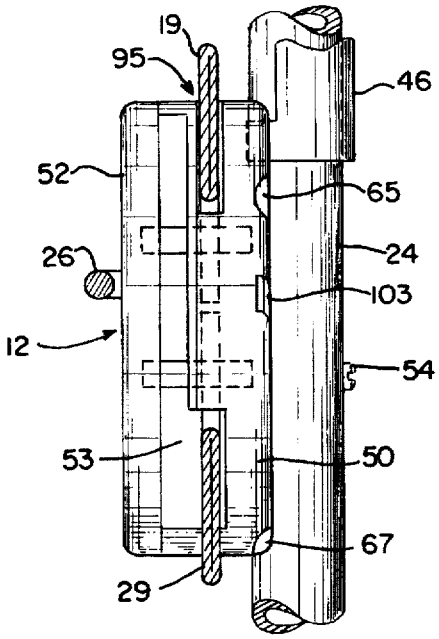
FIG. 6 is a side view of a connector joined to an open frame member and partially exposing the inner and outer locks within the connector.

FIGS. 1, 2 and 4 illustrate the bassinet in its non-rocking, stationary position wherein the frame member 24 is locked into a vertical position relative to the bassinet's underlying support surface 11. When in this vertical position, the closed end of the frame member 24 can be used as a handle so that the bassinet 10 can be easily carried for relocation purposes. The handle 24, like the other frame members 16, 18, 20 and 22, also has free ends 36, 38 disposed oppositely to its closed end 34. However, the free ends 36, 38 do not converge with free ends 16, 18, 20 and 22 within the respective connectors 12, 14. Rather, the handle 24 is pivotally mounted, preferably by a standard screw 54 to the exterior plates 50 of each connector at a point between each foot 40, 42 and a handle lock 46, 48, as best illustrated in FIG. 6. The free ends 36, 38 each terminate in a foot 40, 42, preferably spherical in configuration. The pair of feet 40, 42 thus rest on the ground support surface 11 when the bassinet 10 is in its erected state and provides for increased stability when the bassinet 10 is in its non-rocking position.

As noted above, the handle member 24 includes a pair of handle locks 46, 48, each of which is fixedly attached to the handle 24 preferably at a point slightly above each of the connectors 12, 14. Each handle lock 46, 48 comprises an elongated arcuate clip which is pivotally attached at 57 to the lower ends of the handle 24. At the lower end of each handle lock are a pair of tabs 62, 64 which releasably fit within corresponding slots 66, 68 within each connector outer plate 50. Pressing each handle lock 46, 48 releases the tabs 62, 64 from their engagement with the respective slots and allows the handle 24 to be tilted away from the vertical position for adjustment of the degree of rocking, as shown in FIG. 2.

When the handle locks 46, 48 are pressed simultaneously, the handle 24 is lowered toward a horizontal position as indicated by the directional arrows in FIG. 2 is locked in a selected groove 65, 67 on the outer plate 50. The feet 40, 42 will thus begin to be raised from contact with the ground support surface 11. The handle 24 may be pivotally adjusted into a plurality of positions after the handle locks 46, 48 are depressed, between the locked upright, vertical position and a locked angular position wherein the handle 24 rests lightly on one of the frame members 16, 20. In this manner, the degree of the bassinet's 10 lateral rocking may be selectively regulated. Thus, the degree of rocking is greatest when the handle 24 is in the angular position shown in FIG. 1, as the feet 40, 42 no longer contact the ground support surface 11; and the degree of rocking will be reduced as the handle 24 is adjusted toward the vertical position shown in FIGS. 1, 2 and 4, since the feet 40, 42 retain more consistent contact with the ground support surface 11 when the bassinet 10 is laterally rocked.

Figure 3:
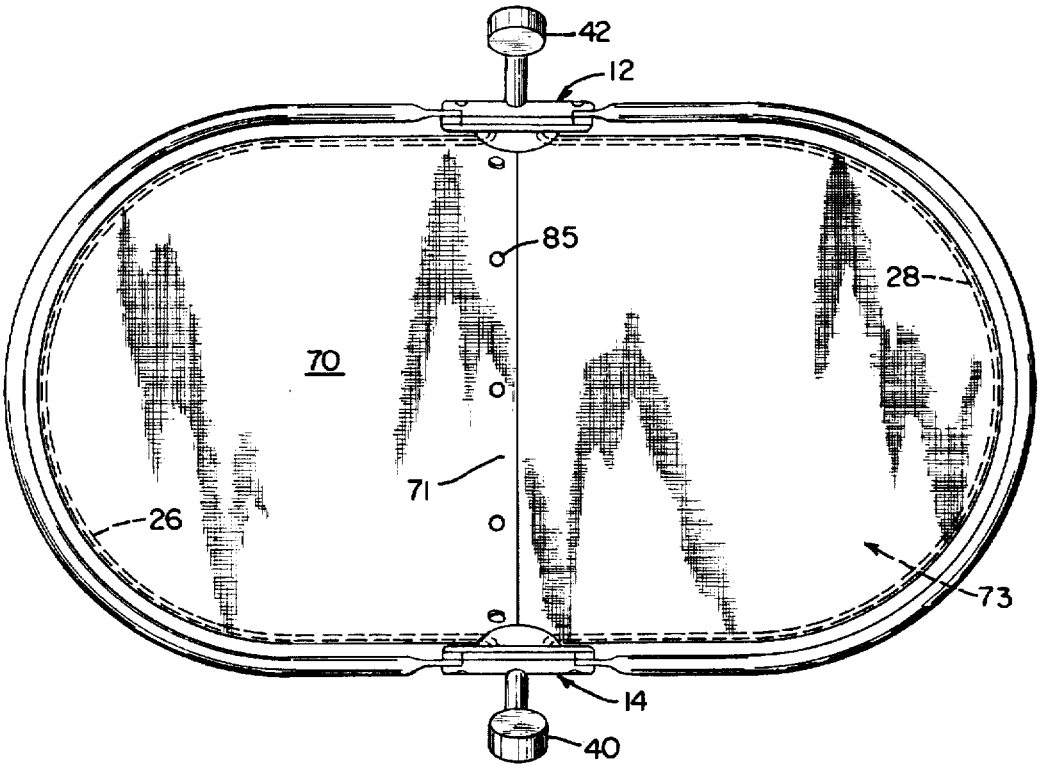
FIG. 3 is a bottom view of the bassinet of the present invention showing the supporting feet and underside of the basket.

As best illustrated in FIGS. 2, 3, and 4, a pair of mattress retention hoops 26, 28 comprise generally U-shaped members each having a closed end and a pair of free ends 33, 35, which pivotally engage an inner plate 52 of each respective connector 12, 14, in a manner to be described and similarly to the ground-engaging frame members 18, 22 and basket-engaging frame members 16, 20.

As noted above, the basket 30 is of generally oval configuration and includes a flat, bottom surface 70, a pair of substantially parallel longitudinal side walls 72, 74, and a pair of arcuate end walls 76, 78. Along its upper peripheral edge 79, the basket includes a fringe or overlap 80 doubled upon itself. The basket-engaging frame members 16, 20 are inserted into the pocket-shaped interior of the overlap 80 at opposite arcuate ends 76, 78 of the basket so that the overlap 80 covers the frame members 16, 20, and the end walls 76, 78 are bowed upwardly relative to the side walls 72, 74. The overlap 80 and end walls 76, 78 of the basket are equipped with complementary attachment means, preferably standard snaps, so that the basket 30 is releasably suspended from the frame members 16, 20.

As shown in FIG. 3, the flat bottom surface 70 of the basket 30 includes an intermediate, transversely extending slot 71 which opens to a longitudinally extending recess or pocket on the underside of the bottom surface 70 of the basket 30 and which extends the full length and width of the basket 30. The mattress retention hoops 26, 28 are slidably inserted in opposite directions to one another into a respective end of the recess 73 to extend from the connectors 12, 14 with their closed ends engaging opposite longitudinal ends 76, 78 of the bassinet 10. Once the mattress retention hoops 26, 28 are in place at their respective ends of the basket's longitudinal recess 73, the flat, bottom surface 70 of the basket 30 acquires a rigidity and size adapted to accommodate and support a complementary sized mattress which can be placed within the basket 30. Preferably, the lateral slot 71 includes fastening means 85, such as, standard snaps, so that the slot 71 may be closed once the mattress retention hoops 26, 28 are in place, as shown in FIG. 3.

Figure 5:
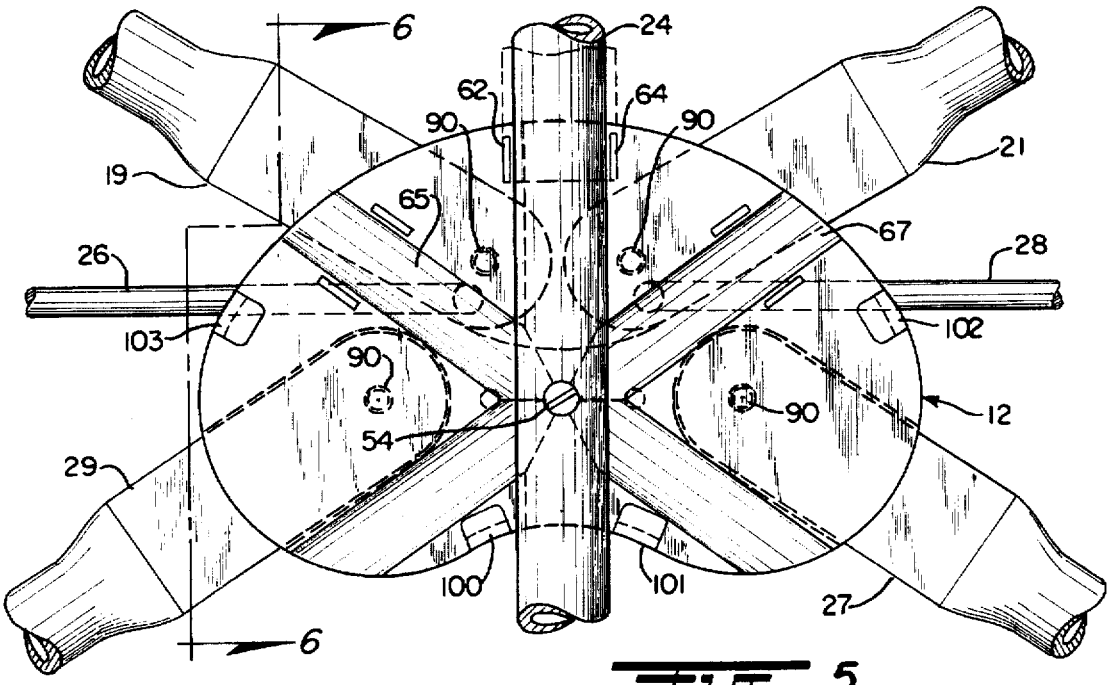
FIG. 5 is a cross-sectional view of the connector in the bassinet of the present invention where all open frame members are commonly joined.

As alluded to above, the connectors 12, 14 located at opposite sides of the bassinet 10 serve as a common pivotal support for the frame members. As best shown in FIGS. 5 and 6, each of the connectors 12, 14 comprises a plurality of generally kidney-shaped, superimposed retainer plates, including an outer plate 50, a middle plate 53, and an inner plate 52. The plates 50, 52, 53 are joined to one another by standard screws or bolts 99 which are threaded through aligned bores within each of the plates 50, 52, 53. The outer plate 50 and middle plate 53 are releasably secured to one another in a plurality of clips 100, 101, 102, 103. Between the middle and outer plate are cavities in which the free ends 19, 21, 27, 29 converge, as shown in FIG. 5. Each free end is pivotally attached to the inner plate via a pivot or bolt 90.

As shown in FIG. 6, a plurality of arcuate but open slots 95, diverge radially and outwardly from the center of the cavity, as well as from the respective pivot points 90, and are sized to accommodate the pivotal movement of the free ends 19, 21 and 27, 29 through the slots. Each slot includes an offset portion into which a respective free end may be engaged so as to lock the respective frame member into the desired non-rocking position.

The free ends 33, 35 terminate in a 90° angle, or L-shape, which extend through bores in each respective inner plate 52 into a hollow between the inner and middle plates, thus allowing pivotal adjustment of the hoops.

As noted above, the handle 24 is fixedly attached to the outer plate of the connectors 12, 14. Adjustment or other movement of the handle 24 involves pivoting the handle 24 about the point of attachment 54.

When the handle 24 is locked into the upright, vertical position shown in FIGS. 1, 2 and 4, the remaining frame members 16, 18, 20, 22 and mattress retention hoops 26, 28 may be pivoted upwardly to be in parallel relation to the handle 24 by slidably adjusting their respective free ends through the slots 95. In this manner, the closed ends 13, 15, 41, 43 will then all be oriented upwardly relative to the connectors 12, 14 and feet 40, 42, even when the basket 30, without the mattress within, is still attached to the frame.

When the bassinet 10 is later retrieved from storage or it is otherwise desired to erect the bassinet 10, the user simply spreads apart the frame members 16, 18, 20, 22, 24 so that their respective free ends slide within the connector slots 95, 96, 97, 98 and are locked into place in the respective offset portions. The infant's mattress may then be placed into the basket 30 so that the bassinet 10 is again ready for use as described above.

It is therefore to be understood that while the preferred form of the invention is herein set forth and disclosed that modifications and changes may be made therein without departing from the spirit and scope of the present invention as defined by the appended claims.

I claim:

1. A rocking bassinet for an infant having a variable degree of rocking, comprising:

a pair of connectors comprising a plurality of generally kidney-shaped retainer plates, said plates superimposed upon one another, secured together, and having a plurality of cavities therebetween, said connectors including a plurality of open, arcuate slots diverging radially and outwardly from said cavities;

open frame members each having a pair of free ends, each said free end secured to one of said plates for pivotal movement through one of said slots, at least one of said frame members forming a ground-engaging member for supporting said bassinet in a rocking position;

a handle member pivotal about said connectors between a ground-engaging position to prevent rocking and a non-ground engaging position;

a handle lock pivotally attached to said handle, said handle lock comprising a generally elongated clip having a pair of tabs releasably engaged to one of said retainer plates, and wherein depression of said handle lock allows pivotal adjustment of said handle, thereby adjusting said degree of rocking.

2. A bassinet according to claim 1 wherein said handle is pivotal between a locked, upright position and a locked, angular position between vertical and horizontal, said upright position preventing rocking of said bassinet and said angular position allowing rocking of said bassinet.

3. A bassinet according to claim 2 wherein said pair of connectors are located on opposite sides of said bassinet.

4. A bassinet according to claim 3 wherein each of said frame members is a substantially U-shaped rigid tubular hoop, one of said free ends disposed in pivotal engagement with one of said connectors and the second free end disposed in pivotal engagement with the second connector.

5. A bassinet according to claim 4 further comprising a pliable basket detachably engaged to at least two of said open frame members, said basket comprising a flat bottom surface, a pair of sidewalls, and a pair of arcuate ends, said bottom surface including a lateral slot leading to a longitudinal recess.

6. A bassinet according to claim 5 wherein said frame members include a pair of mattress retention hoops, said hoops received into said longitudinal recess.

7. A bassinet according to claim 6 wherein said handle includes free ends having supporting feet.

8. A bassinet according to claim 7 wherein said basket includes means for securing said basket to said frame members.

9. A rocking bassinet for placement upon a support surface comprising, a pair of connectors;

at least three open frame members pivotal about said pair of connectors, one of said open frame members pivotal between a vertical ground-engaging position to prevent rocking of said bassinet and a non-ground engaging position, and wherein two other said open frame members form curved, ground-engaging members for engaging the support surface and for supporting a bassinet in said rocking position; and means for adjusting the position of said frame members with respect to said pair of connectors.

10. A bassinet according to claim 9 wherein said connectors comprise a plurality of generally kidney-shaped retainer plates, said plates superimposed upon one another, secured together, and having a plurality of cavities therebetween, said connectors including a plurality of slots diverging radially and outwardly from said cavities.

11. A bassinet according to claim 10 wherein each of said frame members has a pair of free ends, each said free end secured to one of said plates for pivotal movement through one of said slots.

12. A bassinet according to claim 11 wherein one of said open frame members is a handle, pivotal between a ground-engaging position to prevent rocking and a non-ground-engaging position.

13. A bassinet according to claim 12 wherein said adjustment means is a handle lock, said handle lock comprising a generally elongated clip pivotally attached to said handle and having a pair of tabs releasably engagable to one of said retainer plates, and wherein depression of said handle lock releases said tabs from engagement with said retainer plate for pivotal adjustment of said handle.

14. A bassinet according to claim 13 wherein said adjustment of said handle varies the degree of rocking of said bassinet.

15. A bassinet according to claim 14 wherein said frame numbers include a pair of mattress retention hoops.

16. A bassinet according to claim 15 wherein said pair of connectors are located on opposite sides of said bassinet.

17. A bassinet according to claim 16 wherein each of said frame members is of generally U-shaped configuration, and wherein one of said free ends is disposed in pivotal engagement with one of said connectors and the second free end is disposed in pivotal engagement with another of said connectors.

18. A bassinet according to claim 17 further comprising a pliable basket detachably engaged to at least two of said open frame members, said basket comprising a flat bottom surface, a pair of sidewalls, and a pair of arcuate ends, said bottom surface including a lateral slot which leads to a longitudinal recess, said recess adapted to receive said mattress retention hoops.

19. A bassinet according to claim 18 wherein said basket includes a canopy removably engageable around one end of said basket and adapted to extend over said end of the basket thereby providing protection from sun, wind or rain to an infant lying prone in said basket.

20. A bassinet according to claim 19 wherein said handle is adapted for pivotal adjustment between a substantially vertical position and a substantially horizontal position in relation to a support surface.

21. A bassinet according to claim 20 wherein said vertical positioning of said handle prevents rocking of said bassinet.

22. A bassinet according to claim 21 wherein said horizontal positioning of said handle allows rocking of said bassinet.

23. A bassinet according to claim 22 wherein said bassinet is laterally rockable.

24. A bassinet according to claim 23 wherein said free ends include supporting feet.

25. A bassinet according to claim 24 wherein said frame members are substantially rigid tubular hoops.

26. A bassinet according to claim 25 wherein said basket includes means for securing said basket to said frame members.

27. A collapsible rocking bassinet for placement upon a support surface comprising:

a pair of connectors;

a U-shaped handle having a closed end for carrying said bassinet and free ends pivotal about said connectors between a ground-engaging position to prevent rocking and a non-ground engaging position;

open frame members pivotal about said connectors to a parallel relation to said handle;

a pair of said frame members forming curved, ground-engaging supports for engaging the support surface when a bassinet is in said rocking position;

a pliable basket detachably engeagable with said frame members; and retention hoops insertable within said basket.

* * * * *